US010258080B2

(12) United States Patent
Barrett

(10) Patent No.: US 10,258,080 B2
(45) Date of Patent: Apr. 16, 2019

(54) SMOKING APPARATUSES WITH AN INTEGRATED FILTER HOLDER

(71) Applicant: Randal Barrett, Central Point, OR (US)

(72) Inventor: Randal Barrett, Central Point, OR (US)

( * ) Notice: Subject to any disclaimer, the term of this patent is extended or adjusted under 35 U.S.C. 154(b) by 1191 days.

(21) Appl. No.: 14/505,356

(22) Filed: Oct. 2, 2014

(65) Prior Publication Data

US 2015/0020819 A1 Jan. 22, 2015

Related U.S. Application Data

(63) Continuation-in-part of application No. 13/710,327, filed on Dec. 10, 2012, now abandoned.

(51) Int. Cl.

| | |
|---|---|
| ***A24F 1/28*** | (2006.01) |
| ***A24D 3/06*** | (2006.01) |
| ***A24F 1/02*** | (2006.01) |
| ***A24F 13/06*** | (2006.01) |

(52) U.S. Cl.

CPC ..... *A24F 1/28* (2013.01); *A24D 3/067* (2013.01); *A24F 1/02* (2013.01); *A24F 13/06* (2013.01)

(58) Field of Classification Search

CPC ... A24F 1/28; A24F 13/06; A24F 1/02; A24D 3/067

See application file for complete search history.

(56) References Cited

U.S. PATENT DOCUMENTS

| | | | | |
|---|---|---|---|---|
| 1,118,276 | A | 11/1914 | Fredericks | |
| 1,462,425 | A | 7/1923 | Shaw | |
| 1,553,519 | A | 9/1925 | Doty | |
| 2,024,540 | A | 12/1935 | Schnaier | |
| 2,106,747 | A | 2/1938 | Jellinghaus | |
| 2,144,393 | A | 1/1939 | Schnaier | |
| 2,263,464 | A | 11/1941 | Lackow et al. | |
| 2,542,612 | A * | 2/1951 | Arneson | A24D 1/04 131/187 |
| 2,598,770 | A | 6/1952 | Drozt | |
| 2,933,091 | A | 4/1960 | Ostergard | |
| 3,292,638 | A | 12/1966 | Lorquet | |
| D246,603 | S | 12/1977 | Frost | |
| 4,224,953 | A | 9/1980 | Alvarez | |
| 4,362,169 | A | 12/1982 | Calkins | |

(Continued)

*Primary Examiner* — Michael H. Wilson
*Assistant Examiner* — Dionne W. Mayes
(74) *Attorney, Agent, or Firm* — Procopio Cory Hargreaves and Savitch LLP

(57) ABSTRACT

A smoking apparatus including a substantially hollow stem defining a bore having a bore diameter, the hollow stem including a first end, a second end disposed opposite the first end. A bowl is situated proximate the first end of the hollow stem and is configured to receive smoking product. The smoking apparatus includes a filter holder comprising a filter stop, a retainer lip, and a filter region. The filter stop is disposed between the first and second ends. The retainer lip is defined by the second end of the hollow stem, projects into the hollow stem, and defines a retainer lip opening providing space for fluid communication through the retainer lip. The filter region is disposed between the retainer lip and the filter stop. In some examples, the smoking apparatus includes a filter tool to help extract a compressible filter from the filter holder.

14 Claims, 14 Drawing Sheets

(56) References Cited

U.S. PATENT DOCUMENTS

| | | | | |
|---|---|---|---|---|
| 5,178,165 | A * | 1/1993 | DeFelice | A24F 13/06 131/187 |
| 6,148,826 | A | 11/2000 | Lancaster | |
| 6,796,312 | B2 | 9/2004 | Eichel | |
| 2008/0029107 | A1 | 2/2008 | Ruff et al. | |
| 2010/0319716 | A1 | 12/2010 | Tao | |
| 2011/0094524 | A1* | 4/2011 | Glover | A24F 1/30 131/224 |
| 2012/0118306 | A1 | 5/2012 | Mehio | |
| 2012/0186592 | A1* | 7/2012 | Schleider | A24F 1/28 131/191 |
| 2013/0167852 | A1 | 7/2013 | McDonald | |

* cited by examiner

SMOKING APPARATUSES WITH AN INTEGRATED FILTER HOLDER

CROSS REFERENCE TO RELATED APPLICATIONS

The present application is a continuation-in-part of and claims priority to the subject matter in common with co-pending Nonprovisional patent application, Ser. No. 13/710,327, filed on Dec. 10, 2012, the complete disclosure of which is hereby incorporated by reference.

BACKGROUND

Known smoking apparatuses are not entirely satisfactory for the range of applications in which they are employed. For example, the majority of existing smoking apparatuses are not capable of holding in place a screen located in a bowl area of the smoking apparatus. In addition, conventional smoking apparatuses that are capable of holding a screen in place often employ clamps or some other hardware in order for the screen to be held in place and must be disassembled in order for the flexible screen to be removed.

Over the years, pipes, bongs and other smoking or vaporizing apparatuses have been designed with a screen located in the bowl of the device to limit debris generated from the smoking product from being inhaled or ingested by the user. Other advantages of having a screen include: limiting the internal buildup of smoking product in the device, and preventing the smoking product from being wasted as it is drawn out of the bowl.

Despite the many advantages cited for having a screen, most smoking apparatuses are not equipped with this feature due to flaws in their design. Existing designs are complicated and ineffective. One such example of a known design flaw is that current smoking apparatuses require additional hardware to hold a screen in place at the bottom of the bowl. Moreover, the user is then required to disassemble the smoking apparatus in order to remove the screen for cleaning or replacement purposes. Because removal of the screen in this case is time consuming, most users choose not to employ a smoking apparatus of this type. Further, existing smoking apparatuses require a complex and costly manufacturing process, which is less than ideal.

Another design flaw lies in the fact that glass is the material of choice when it comes to smoking apparatuses. Glass offers little resistance against the screen sliding out of place and is thus ineffective at retaining the screens or filtering devices presently employed. Current designs of glass pipes and glass smoking apparatuses are unable to effectively prevent common screen or filtering devices from inadvertently falling out of the glass smoking apparatus and do not provide an easy way to filter out tine particulates. The slickness of the glass material with respect to the screen or filtering device is another reason why current designs are inadequate.

Conventional smoking apparatuses do not provide convenient and effective means for installing, removing, and/or interchanging filters to filter out particulates. Certain known smoking apparatuses require a user to at least partially disassemble the smoking apparatus to install and remove a filter. Some existing smoking apparatuses do not allow the end user to replace the filter. Still other smoking apparatuses require specially configured filters, which limit the end user's choice of filters that may be used in the smoking apparatus.

Thus, there exists a need for smoking apparatuses that improve upon and advance the design of known smoking apparatuses. Examples of new and useful smoking apparatuses relevant to the needs existing in the field are discussed below.

SUMMARY

The present disclosure is directed to a smoking apparatus including a substantially hollow stem defining a bore having a bore diameter, the hollow stem including a first end, a second end disposed opposite the first end. A bowl is situated proximate the first end of the hollow stem and is configured to receive smoking product. The smoking apparatus includes a filter stop disposed between the first and second ends and a retainer lip defined by the second end of the hollow stem and a filter region located between retainer lip and filter stop. The retainer lip projects into the hollow stem and defines an opening providing space for fluid communication through the retainer lip. The filter holder is defined by the retainer lip, filter region and filter stop. In some examples, the smoking apparatus includes a filter tool to help extract a compressible filter from the filter holder.

DETAILED DESCRIPTION

Figure 1:
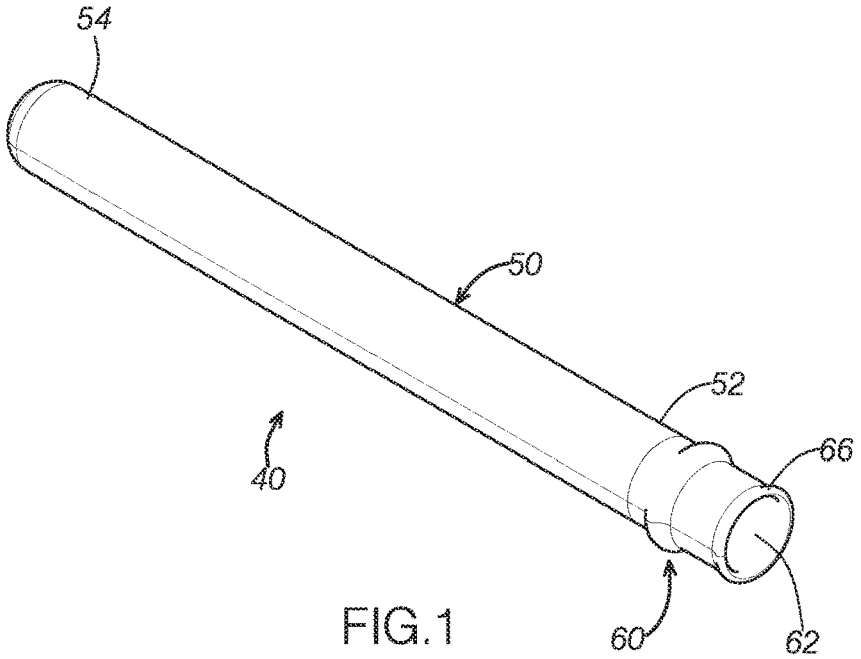
FIG. 1 is a perspective view of a first example of a smoking apparatus.
Figure 2:
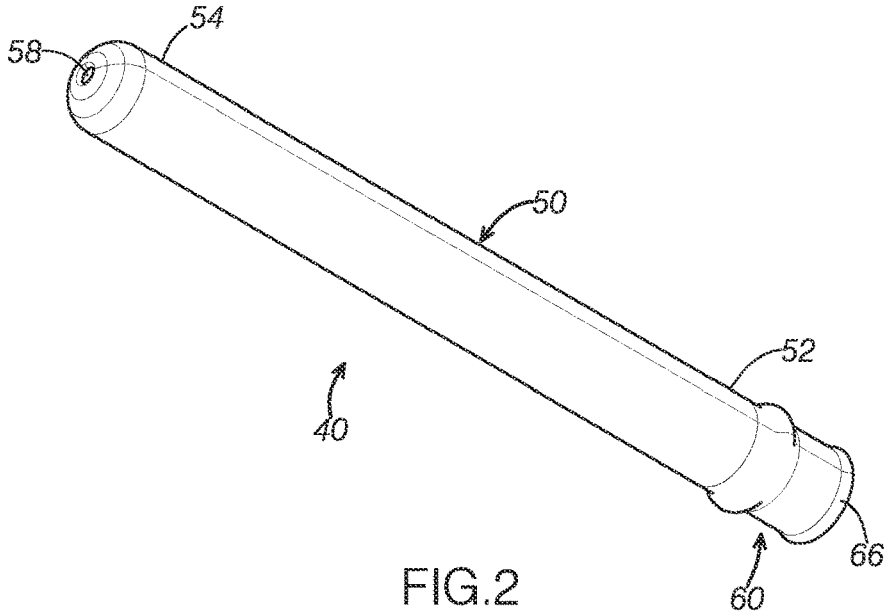
FIG. 2 is a bottom perspective view of the smoking apparatus.
Figure 3:
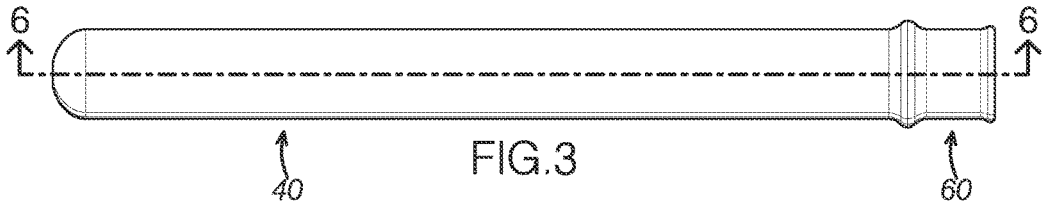
FIG. 3 is a left-side elevation view of the smoking apparatus.
Figure 4:
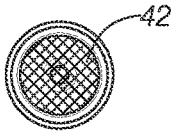
FIG. 4 is a top elevation view of the smoking apparatus with a flexible screen inserted within the smoking apparatus.
Figure 5:
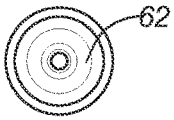
FIG. 5 is a top elevation view of the smoking apparatus without the flexible screen inserted in the smoking apparatus.

The disclosed smoking apparatuses will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various smoking apparatuses are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

With reference to FIGS. 1-7, a first example of a smoking apparatus 40, will now be described. Smoking apparatus 40 includes a substantially hollow stem 50, and a bowl 60 that includes a screen retention area 70. Smoking apparatus 40 functions to contain smoking product in bowl 60, thereby reducing the inhalation of burning or vaporized smoking product by a user.

In use, smoking apparatus 40 reduces the inhalation of burning or vaporized smoking product from reaching a user's lungs by filtering out those harmful elements. A flexible screen 42 is inserted into screen retention area 70 and reduces the likelihood of a user inhaling or ingesting any of the burning smoking material. Additionally or alternatively, the smoking apparatuses described may be used with a varied assortment of glass, metal, ceramic or other heat resistant pipes and bongs, as well as hookah smoking devices.

As can be seen in FIGS. 1-7, hollow stem 50 defines a bore 51 having a bore diameter, where hollow stem 50 further includes a first end 52, a second end 54, an inner wall 56, and a restricted-flow opening 58. First end 52 is disposed opposite second end 54 with restricted flow-opening 58 located proximal second end 54. Bore 51 encompasses the entire length of hollow stem 50. Restricted-flow opening functions to reduce the likelihood of burning smoking product from being inhaled or ingested by the user.

Figure 6:
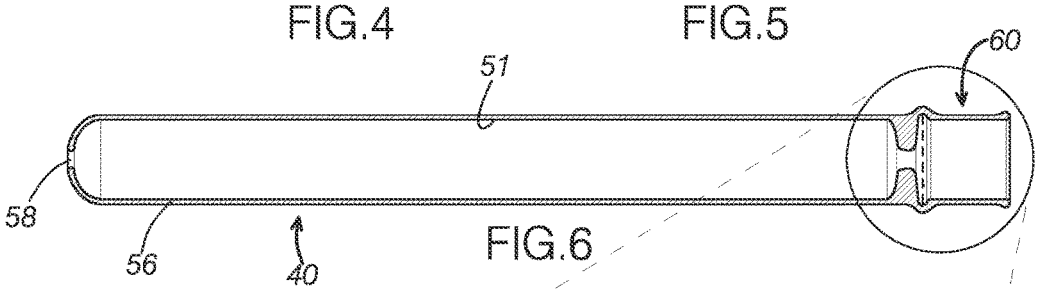
FIG. 6 is a cross-sectional view of the smoking apparatus taken along the line 6-6 shown in FIG. 3.
Figure 7:
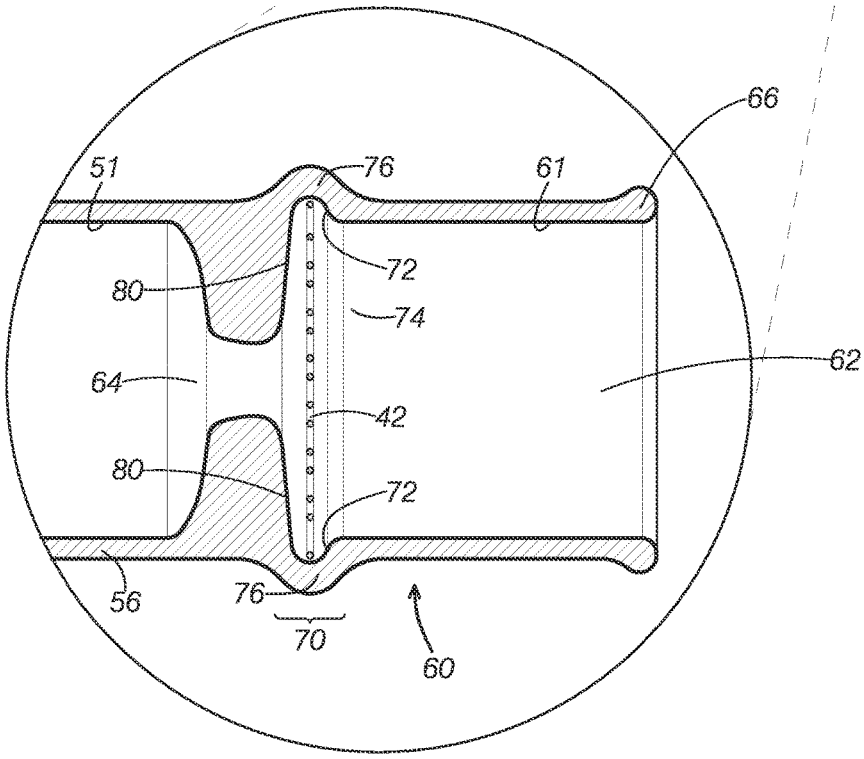
FIG. 7 is an enlarged view of the smoking apparatus shown in FIG. 6 with the flexible screen inserted.

Turning attention to FIGS. 6 and 7, bowl 60 is integrally coupled to and disposed proximal first end 52 and includes an open end 62, a bottom end 64 disposed opposite open end 62, and a reinforced lip 66 located proximal open end 62. Further, bowl 60 defines a bowl bore 61 having a bore diameter. A variety of different smoking products may be inserted into open end 62 of bowl 60 by the user for smoking enjoyment. Additionally, reinforced lip 66 reduces the possibility of damage to bowl 60 if the user drops smoking apparatus 40 onto a hard surface.

As can be seen in FIG. 7, screen retention area 70 further includes a screen retainer 72 disposed proximal bottom end 64 of bowl 60, a lateral boundary region 76, and a shoulder support 80. Lateral boundary region 76 is disposed adjacent screen retainer 72 and extends across bore 61 diameter a distance greater than the inside diameter of bowl 60. Further, lateral boundary region 76 is configured to receive a circumferential edge of flexible screen 42. Screen retainer 72 defines a restricted opening 74 that is less than the outer diameter of flexible screen 42. Once inserted beyond screen retainer 72, flexible screen 42 is held securely in securely in place in lateral boundary region 76 and may not inadvertently fall out of screen retention area 70.

Staying with FIG. 7, shoulder support 80 is disposed adjacent lateral boundary region 76 and protrudes inwardly from lateral boundary region 76 into bore 61 diameter of bowl 60 to support flexible screen 42. Screen retainer 72, lateral boundary region 76, and shoulder support 80 cooperate together to securely retain flexible screen 42 in screen retention area 70. Alternatively, in some examples, the smoking apparatuses may have a shoulder support feature that is discontinuous in nature, such as discrete projections projecting inward from the bowl bore in the screen retention area.

Turning attention to FIGS. 8-16, a second example of smoking apparatus 140 will now be described. Smoking apparatus 140 includes many similar or identical features to smoking apparatus 40. Thus, for the sake of brevity, each feature of smoking apparatus 140 will not be redundantly explained. Rather, key distinctions between smoking apparatus 140 and smoking apparatus 40 will be described in detail and the reader should reference the discussion above for features substantially similar between the two smoking apparatuses.

As can be seen in FIGS. 8-16, smoking apparatus 140 includes a substantially hollow stem 150, and a bowl 160 that includes a screen retention area 170. However, in this example, hollow stern 150 of smoking apparatus 140 has a first end 152 terminating in an arcuate bend, whereas hollow stem 50 of smoking apparatus 40 has a first end 52 terminating in a substantially straight end.

Figure 8:
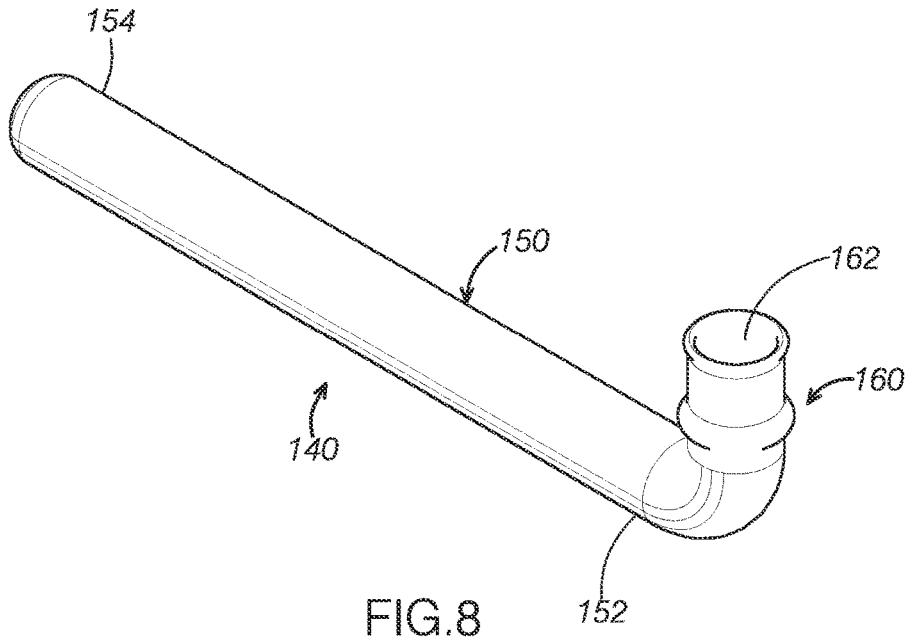
FIG. 8 is perspective view of a second example of a smoking apparatus with a first end terminating in an arcuate bend.
Figure 9:
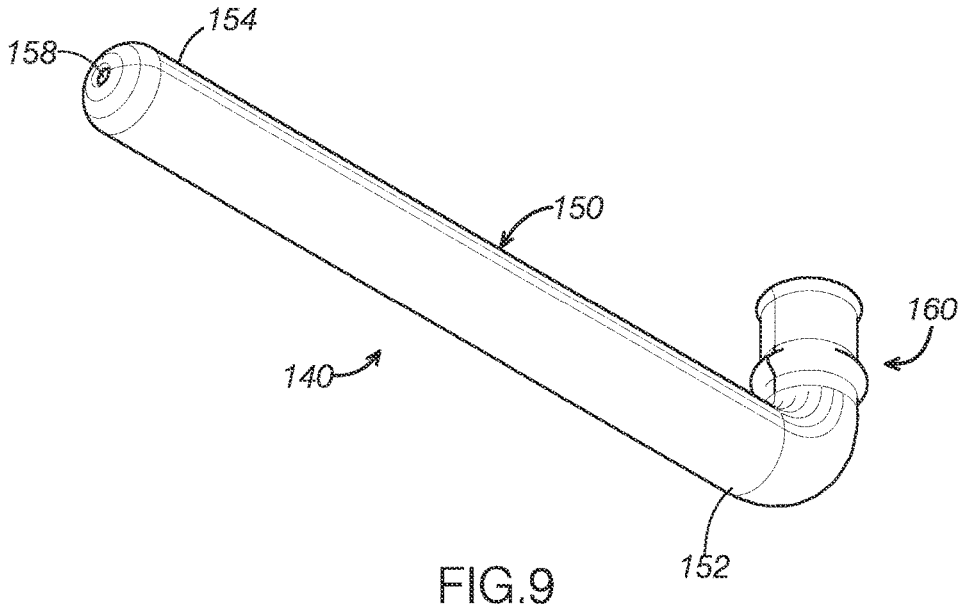
FIG. 9 is a bottom perspective view of the smoking apparatus with the first end terminating in an arcuate bend.
Figure 10:
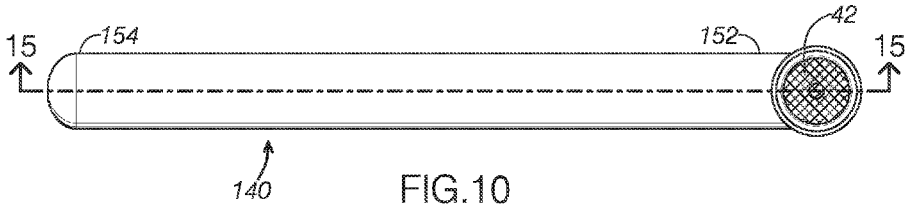
FIG. 10 is a top plan view of the smoking apparatus with the flexible screen inserted.
Figure 11:
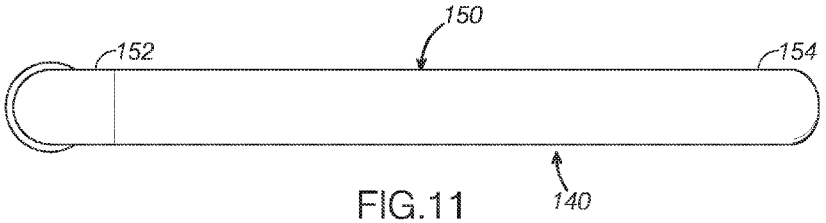
FIG. 11 is a bottom plan view of the smoking apparatus.
Figure 12:
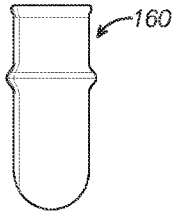
FIG. 12 is a bottom plan view of the first end of the smoking apparatus shown in FIG. 8.
Figure 13:
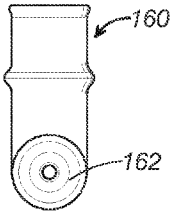
FIG. 13 is a top plan view of the first end of the smoking apparatus shown in FIG. 8 without the flexible screen.
Figure 14:
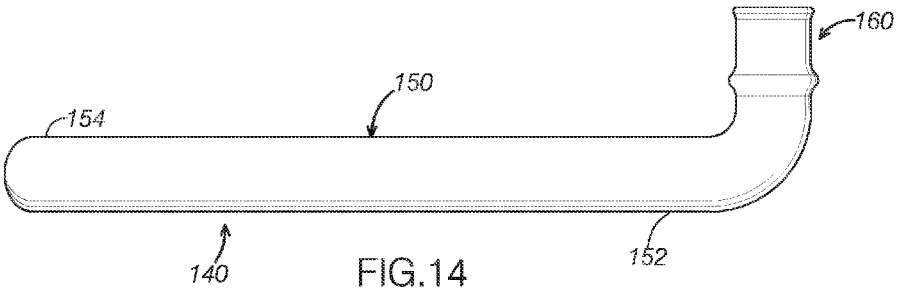
FIG. 14 is a left-side elevation view of the smoking apparatus.
Figure 15:
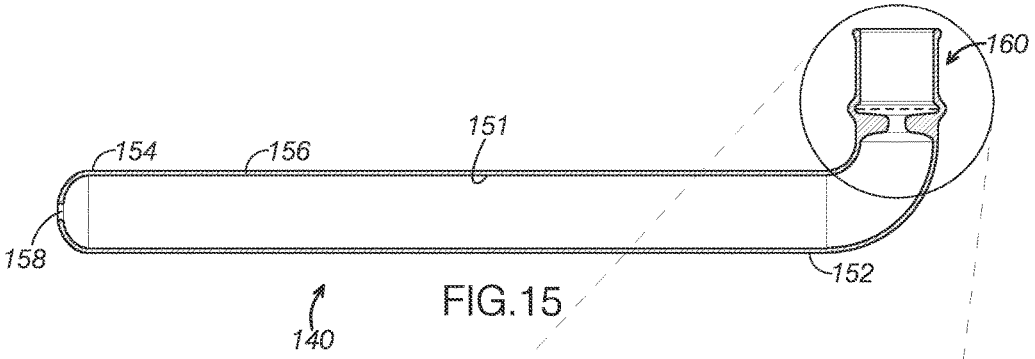
FIG. 15 is a cross-sectional view of the smoking apparatus taken along the line 15-15 shown in FIG. 10.
Figure 16:
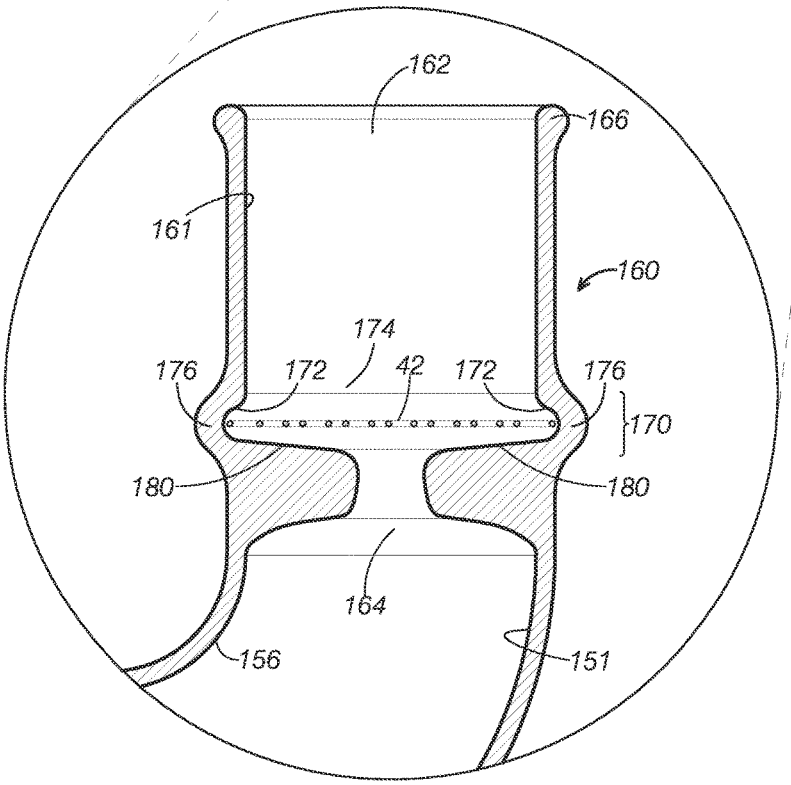
FIG. 16 is an enlarged view of the smoking apparatus shown in FIG. 15 with the flexible screen inserted.
Figure 17:
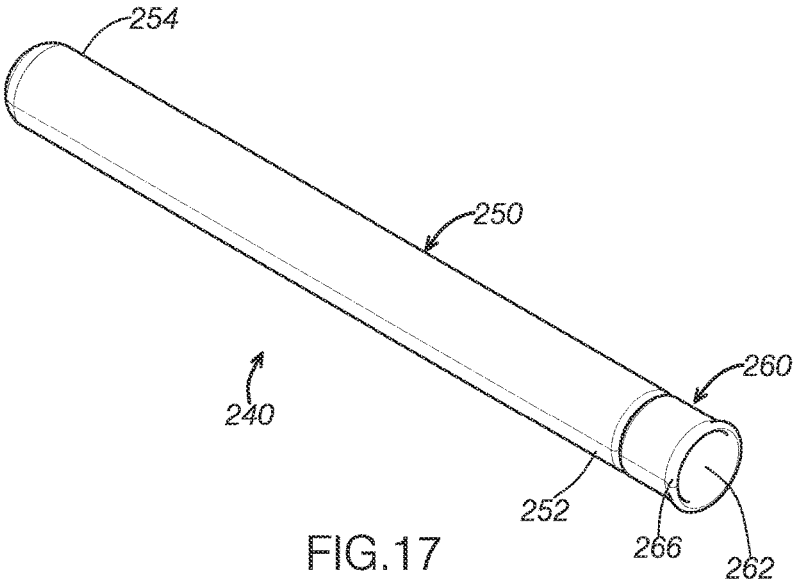
FIG. 17 is a perspective view of a third example of a smoking apparatus.
Figure 18:
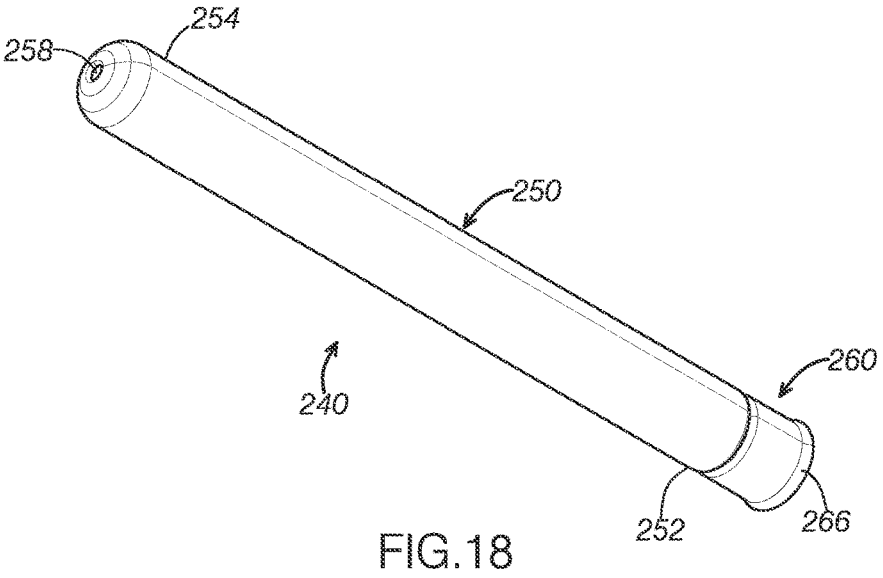
FIG. 18 is a bottom perspective vie:v of the smoking apparatus shown in FIG. 17.
Figure 19:
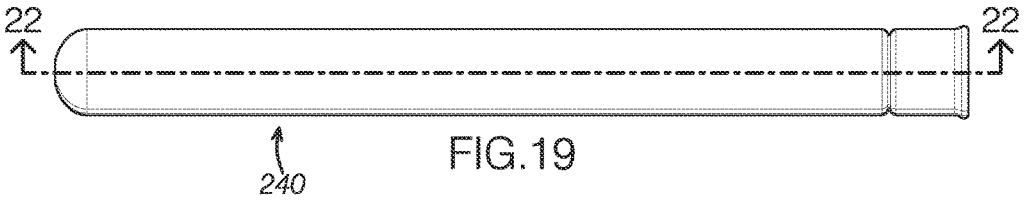
FIG. 19 is a left-side elevation view of the smoking apparatus.
Figure 20:
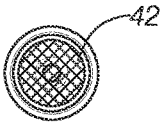
FIG. 20 is top elevation view of the smoking apparatus with the flexible screen inserted.
Figure 21:
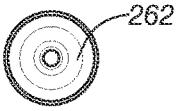
FIG. 21 is a top elevation view of the smoking apparatus without the flexible screen inserted.
Figure 22:
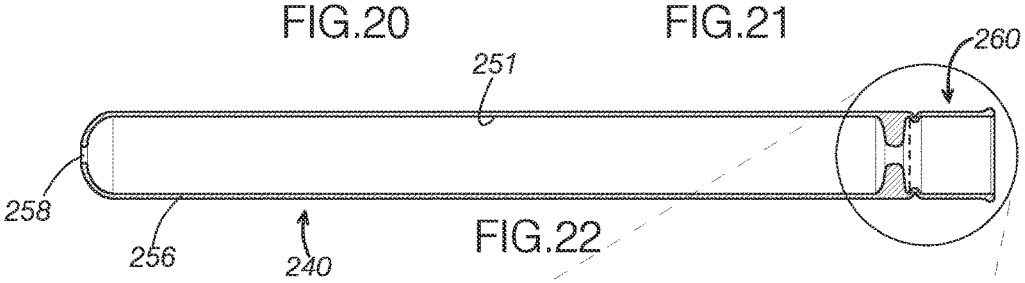
FIG. 22 is a cross-sectional view of the smoking apparatus taken along he line 22-22 shown in FIG. 19.

In FIGS. 8-9, first end 152 terminates in an arcuate bend, whereas first end 52 of smoking apparatus 40 terminates in a straight end. First end 152 having an arcuate bend provides the user with a smoking apparatus having a different directional angle of bowl's open end 62, which allows users different options for lighting smoking product and for the subsequent removal of ashes.

Turning attention to FIGS. 17-23, a third example of a smoking apparatus 240 will now be described. Smoking apparatus 240 includes many similar or identical features to smoking apparatus 40. Thus, for the sake of brevity, each feature of smoking apparatus 240 will not be redundantly explained. Rather, key distinctions between smoking apparatus 240 and smoking apparatus 40 will be described in detail and the reader should reference the discussion above for features substantially similar between the two smoking apparatuses.

As can be seen in FIGS. 17-23, smoking apparatus 240 includes a substantially hollow stem 250, and a bowl 260 that includes a screen retention area 270. However, in this example, screen retainer 272 defines a constriction lip 278 to bore 261.

Figure 23:
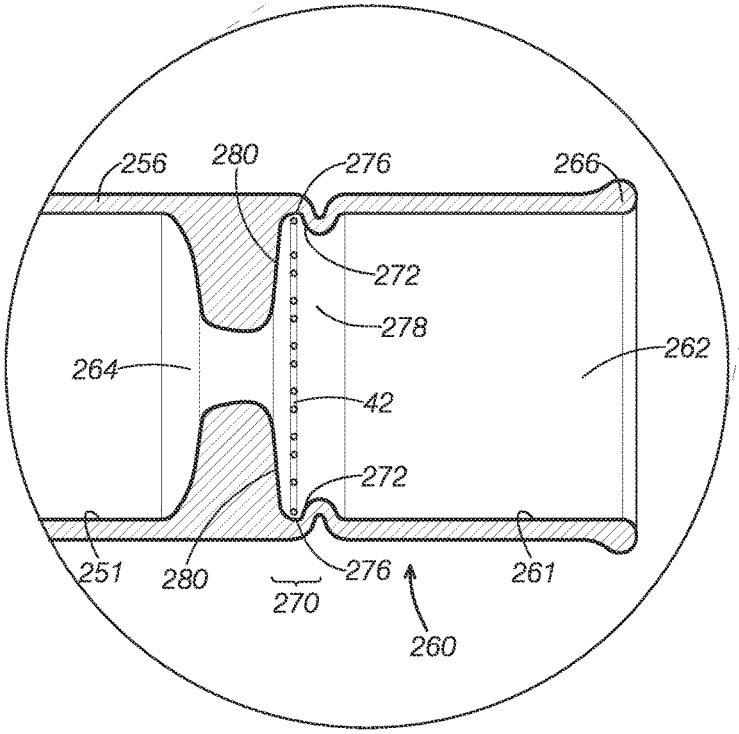
FIG. 23 is an enlarged view of the smoking apparatus shown in FIG. 22 with the flexible screen inserted.

In FIG. 23, screen retainer 272 is disposed proximal bottom end 264 of bowl 260 and defines constriction lip 278 located proximal lateral boundary region 276. Further, the inside diameter of constriction lip 278 is less than the outer diameter of flexible screen 42. Once inserted beyond constriction lip 278, flexible screen 42 is securely held in place in lateral boundary region 276 and is restricted from inadvertently falling out of screen retention area 270. Moreover, screen retainer 278, lateral boundary region 276, and shoulder support 280 cooperate together to retain flexible screen 42 securely in screen retention area 270. Alternatively, in some examples, the smoking apparatuses may have a screen retainer feature that is discontinuous in nature, such as discrete projections projecting inward from the bowl bore in the screen retention area.

Turning attention to FIGS. 24-32, a fourth example of a smoking apparatus 340 will now be described. Smoking apparatus 340 includes many similar or identical features to smoking apparatus 240. Thus, for the sake of brevity, each feature of smoking apparatus 340 will not be redundantly explained. Rather, key distinctions between smoking apparatus 340 and smoking apparatus 240 be described in detail and the reader should reference the discussion above for features substantially similar between the two smoking apparatuses.

As can be seen in FIGS. 24-32, smoking apparatus 340 includes a substantially hollow stem 350, and a bowl 360 that includes a screen retention area 370. However, in this example, hollow stem 350 of smoking apparatus 340 has a first end 352 terminating in an arcuate bend, whereas hollow stem 250 of smoking apparatus 240 has a first end 252 terminating in a substantially straight end.

Figure 24:
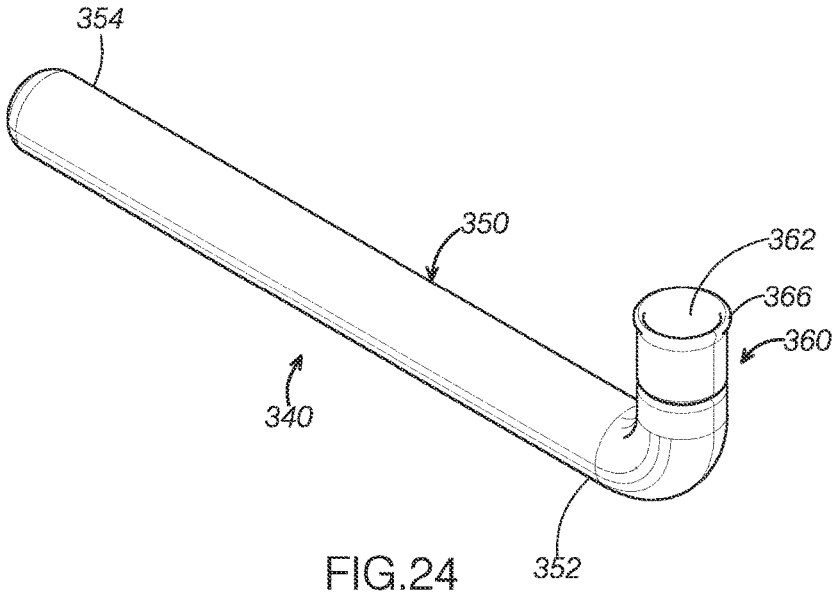
FIG. 24 is a perspective view of a third example of a smoking apparatus with a first end terminating in an arcuate bend.
Figure 25:
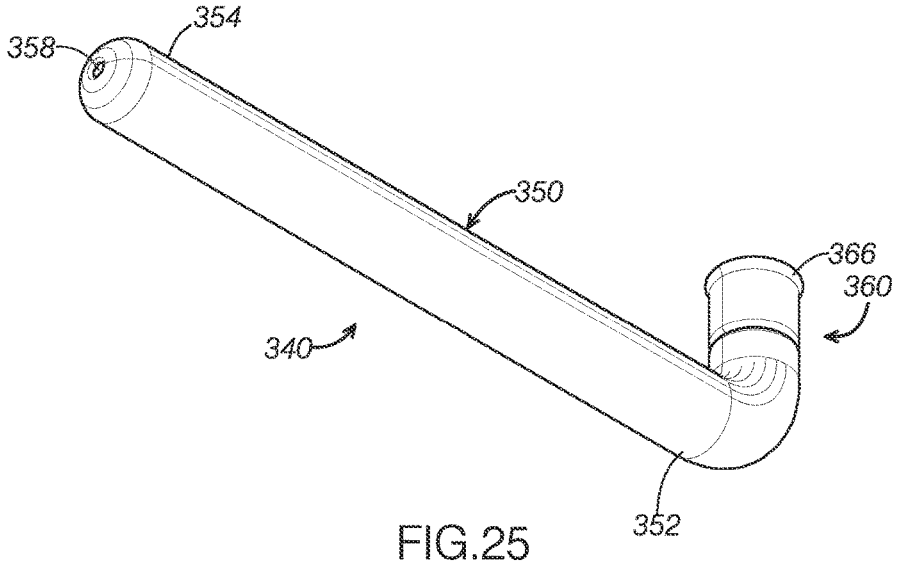
FIG. 25 is a bottom perspective view of the smoking apparatus with the first end terminating in an arcuate bend.
Figure 26:
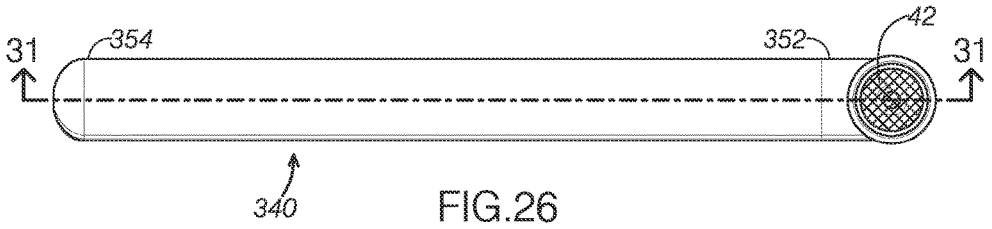
FIG. 26 is a top plan view of the smoking apparatus with the flexible screen inserted.
Figure 27:
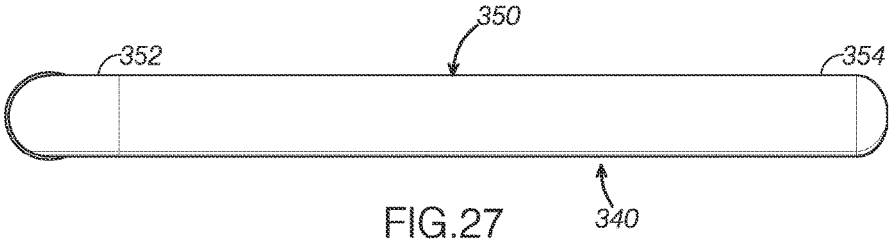
FIG. 27 is a bottom plan view of the smoking apparatus.
Figure 28:
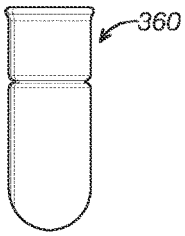
FIG. 28 is a bottom plan view of the first end of the smoking apparatus shown in FIG. 24.
Figure 29:
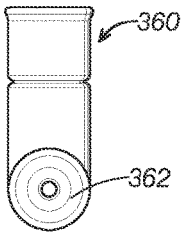
FIG. 29 is a top plan view of the first end of the smoking apparatus shown in FIG. 24 without the flexible screen inserted.
Figure 30:
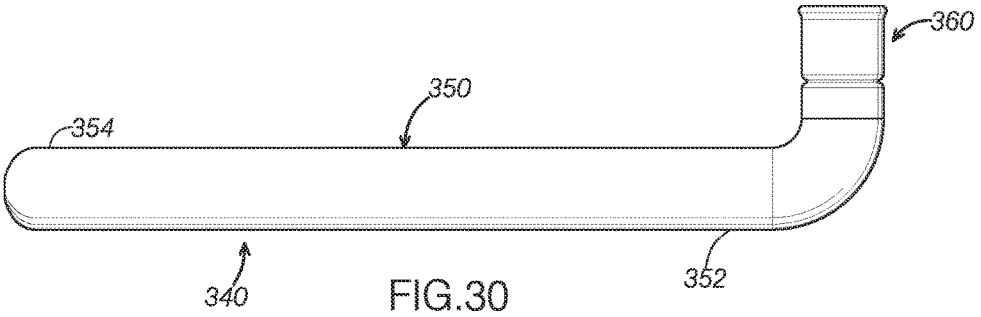
FIG. 30 is a left-side elevation view of the smoking apparatus.
Figure 31:
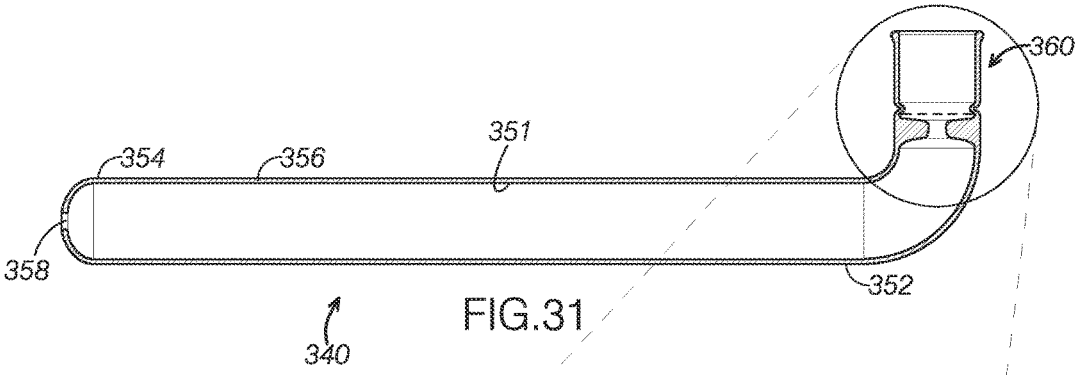
FIG. 31 is cross-sectional view of the smoking apparatus taken along the line 31-31 shown in FIG. 26.
Figure 32:
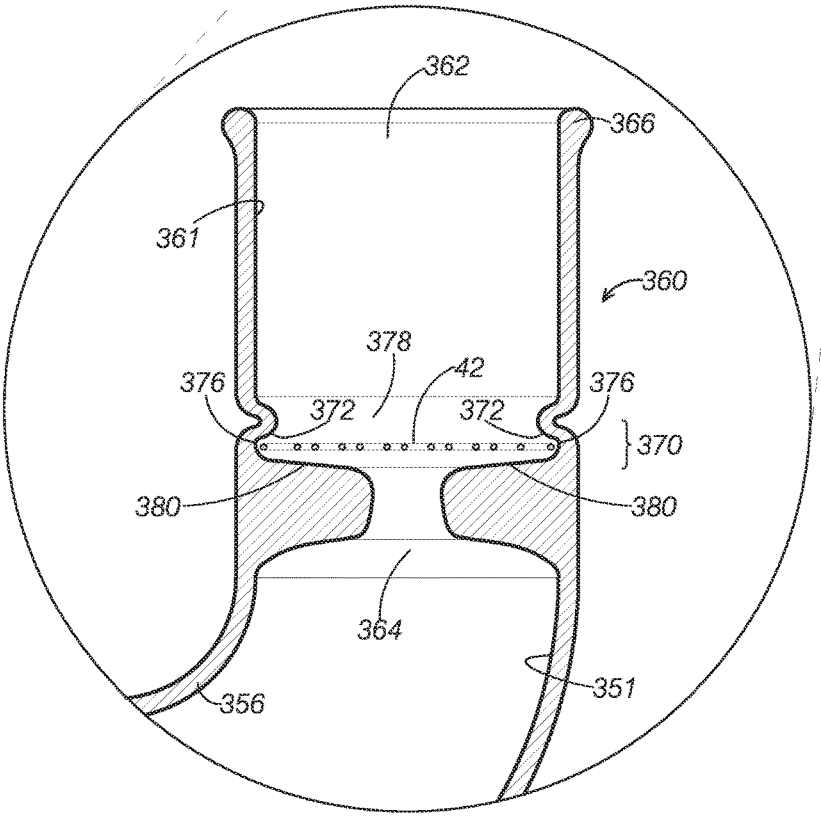
FIG. 32 is an enlarged view of the smoking apparatus shown in FIG. 31 with the flexible screen inserted.
Figure 33:
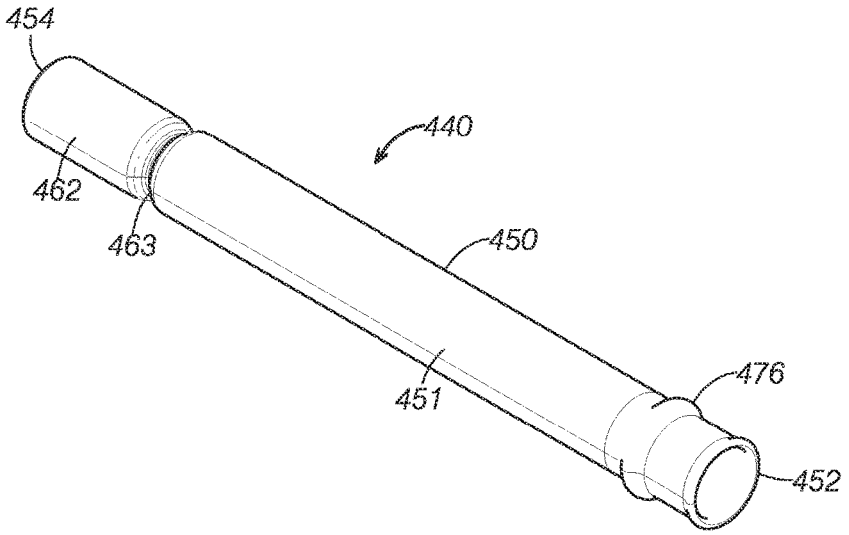
FIG. 33 is a perspective view of the smoking apparatus showing the filter stop.
Figure 34:
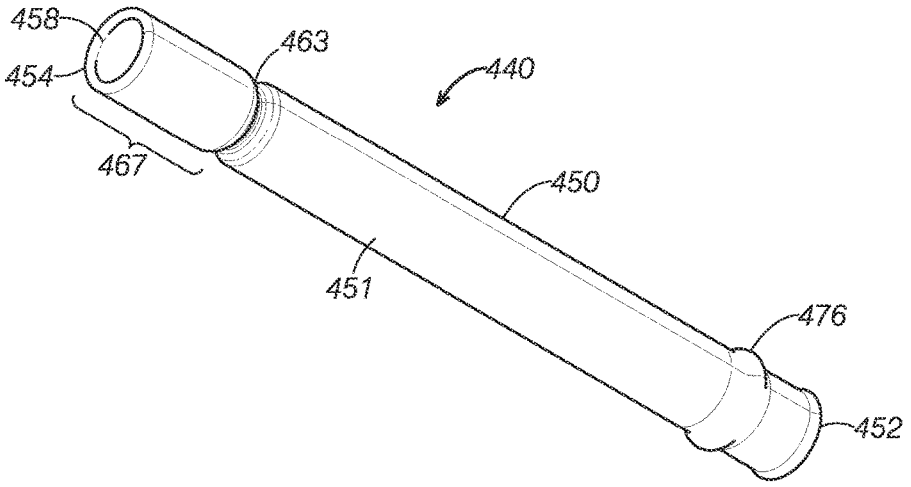
FIG. 34 is a bottom view of the smoking apparatus.
Figure 35:
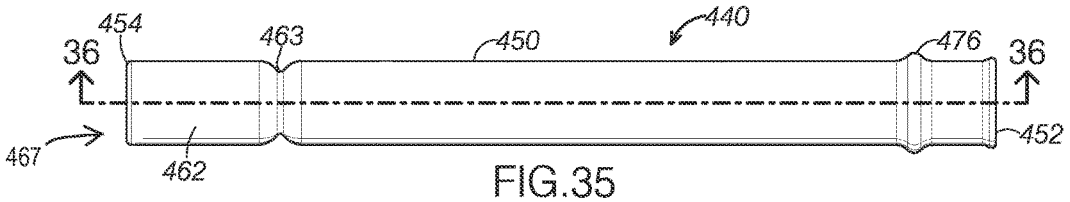
FIG. 35 is a side elevation of the smoking apparatus.
Figure 36:
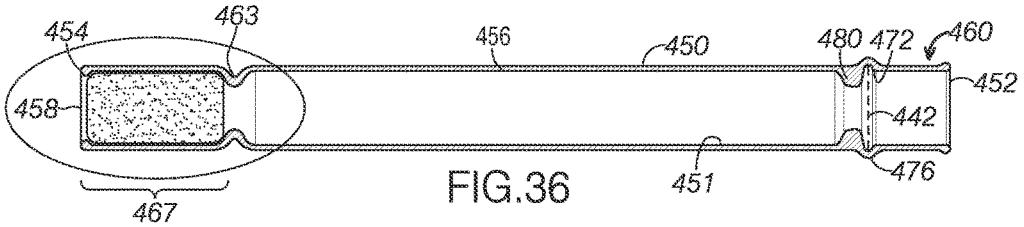
FIG. 36 is a cross-sectional view of the smoking apparatus taken along the line 36-36 in FIG. 35.

In FIGS. 24-25, first end 352 terminates in an arcuate bend, whereas first end 252 of smoking apparatus 240 terminates in a straight end. First end 352 having an arcuate bend provides the user with a smoking apparatus having a different directional angle of bowl's open end 362, which allows users different options for lighting smoking product and for the subsequent removal of ashes.

Turning to FIGS. 33-39, a fifth example of a smoking apparatus, smoking apparatus 440, will now be described. Smoking apparatus 440 includes many similar or identical features to smoking apparatuses 40 and 240. Thus, for the sake of brevity, each feature of smoking apparatus 440 pill not be redundantly explained. Rather, key distinctions between smoking apparatus 440 and smoking apparatuses 40 and 240 will be described in detail and the reader should reference the discussion above for features substantially similar between the two smoking apparatuses.

Smoking apparatus 440 has benefits beyond the previous designs described above as well as over other smoking apparatus designs on the market. Smoking apparatus 440 includes a filter holder 467, which provides a space for receiving a filter close to user's mouth. Filter holder 467 allows the user to place a filter in smoking apparatus 440 with his fingers. Placing such a filter in smoking apparatus 440 reduces the amount of harmful particulates that would enter the user's mouth and lungs upon burning and vaporizing the smoking product and upon subsequent inhalation. Smoking apparatus 440 also includes a filter tool 490 which aids in extracting the compressible filter from smoking apparatus 440.

As FIGS. 33-36 show, smoking apparatus 440 also includes a hollow stein 450 defining a bore 451 having a bore cross-sectional dimension (in the case where the bore cylindrical, this value would correspond to a bore diameter). Hollow stem 450 includes a first end 452, a second end 454, an inner wall 456, and a retainer lip 458. Similar to smoking apparatuses 40 and 240, first end 452 of smoking apparatus 440 is disposed opposite second end 454. However, unlike the smoking apparatuses discussed above, smoking apparatus 440 includes filter holder 467 located proximate second end 454.

As shown in FIGS. 35-37B, filter holder 467 includes a filter stop 463, retainer lip 458, and filter region 462. Filter stop 463 extends into bore 451 and is spaced from second end 454 and retainer lip 458. Retainer lip 458 also extends into bore 451 and is defined by second end 454 of hollow stem 450.

Figure 37A:
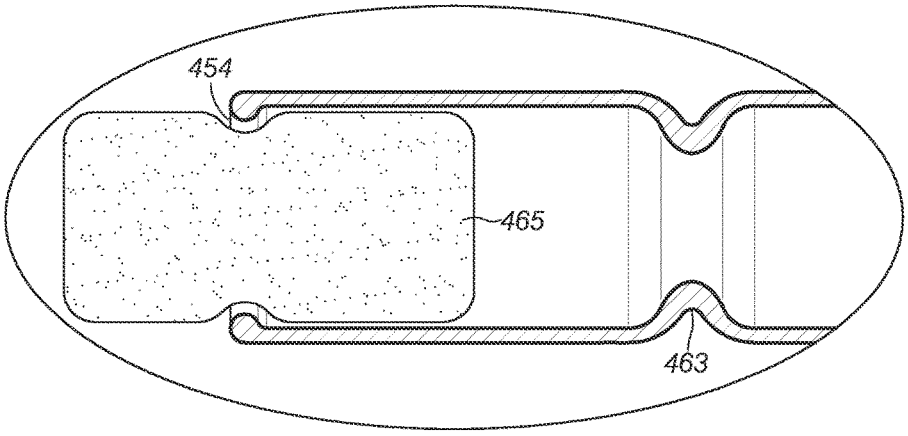
FIG. 37*a* is a close up of the compressible filter passing through the retainer lip of the smoking apparatus.
Figure 37B:
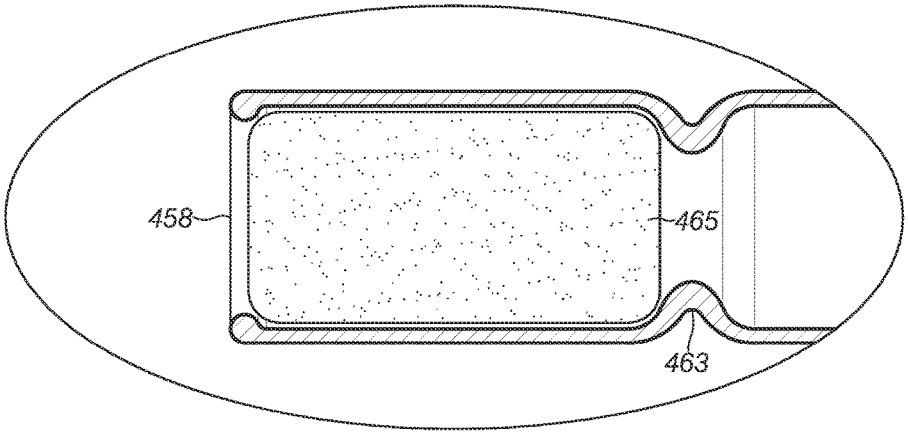
FIG. 37*b* is a close up of the filter stop and retainer lip with a filter in place.

FIGS. 37*a* and 37*b* show that filter stop 463 and retainer lip 458 define filter region 462 between them. Compressible filter 465 can be housed between filter stop 463 and retainer lip 458 in filter region 462 of filter holder 467. Compressible filter 465 is inserted through second end 454, often by a user pushing filter 465 through second end 454 with his fingers. FIG. 37A shows that compressible filter 465 compresses as it passes through the opening of the retainer lip 458.

Once compressible filter 465 is pushed past the opening of retainer lip 458, it becomes substantially uncompressed and seats within filter region 462 of filter holder 467 in a substantially uncompressed state. The size of compressible filter 465 and the major dimension of bore 451 are complimentarily configured to enable compressible filter 465 to be disposed in filter region 462 in a substantially uncompressed state. In this case, the major cross-sectional dimension of bore 451 corresponds with the diameter of bore 451.

Compressible filter 465 is used to filter out particulates originating from burning or vaporizing a smoking product and restricts or prevents such particulates from reaching a user's lungs. Compressible filter 465 may be any currently known or later developed smoking filter made of a compressible material that compresses when passing through a constricted area and uncompresses when allowed to re-expand within the boundaries of a container. Any suitable compressible material may be used. (Compressible filter 465 is configured to reduce particulates from passing to a user's lungs when the user is using smoking apparatus 440.

In order for compressible filter 465 to pass through the opening of retainer 458, its cross sectional dimension is selected to enable the opening of retainer lip 458 to accommodate the compressed dimensions of compressible filter 465. In other words, when the cross section of the interior opening of the retainer lip is circular, the diameter of the interior openings is set to accommodate the cross section of compressed filter 465 in a compressed state. Expressed another way, the cross section dimension of the interior opening of the retainer lip is set to accommodate the cross section dimensions of the compressible filter in a compressed state.

While the interior openings defined by bore 451, shoulder support 480, filter stop 463, and retainer lip 458 are circular, the interior openings may be any suitable shape. In other examples, the cross sections of the interior openings are non-circular, such as ovoid, rectangular, square or of irregular shape.

The cross section dimensions of the interior openings can be described in terms of a major dimension across the opening and a minor dimension across the opening. In the case of circular opening, as shown in the figures, the major and minor dimensions both correspond to the diameter of the opening. When the interior opening is rectangular with a longer length than width dimension, the major dimension is the length of the rectangular opening and the minor dimension is the width of the opening. In the case where the width of the rectangular opening was longer than the length, the major dimension would instead be the width and the minor dimension would be the length. In instances where the length and width dimensions were equal, as in the square and circular opening examples, the major and minor dimensions are the same.

When considered in terms of the major and minor dimensions of the interior opening of the retainer lip, the major and minor dimensions of the interior opening of the retainer lip is complimentarily configured with the corresponding major and minor dimensions of a compressible filter in a compressed state to allow the compressed filter to pass through the interior opening of the retainer lip. For a given smoking apparatus, the user may select a compressible filter with major and minor dimensions that are similarly configured to fit through the opening of retainer lip 458 of the smoking apparatus.

Figure 38:
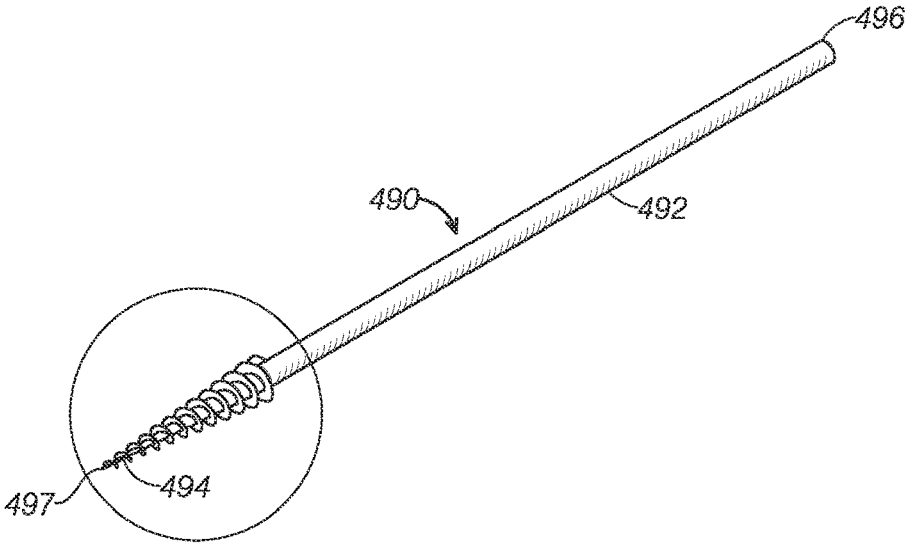
FIG. 38 is a perspective drawing of the filter tool.
Figure 39:
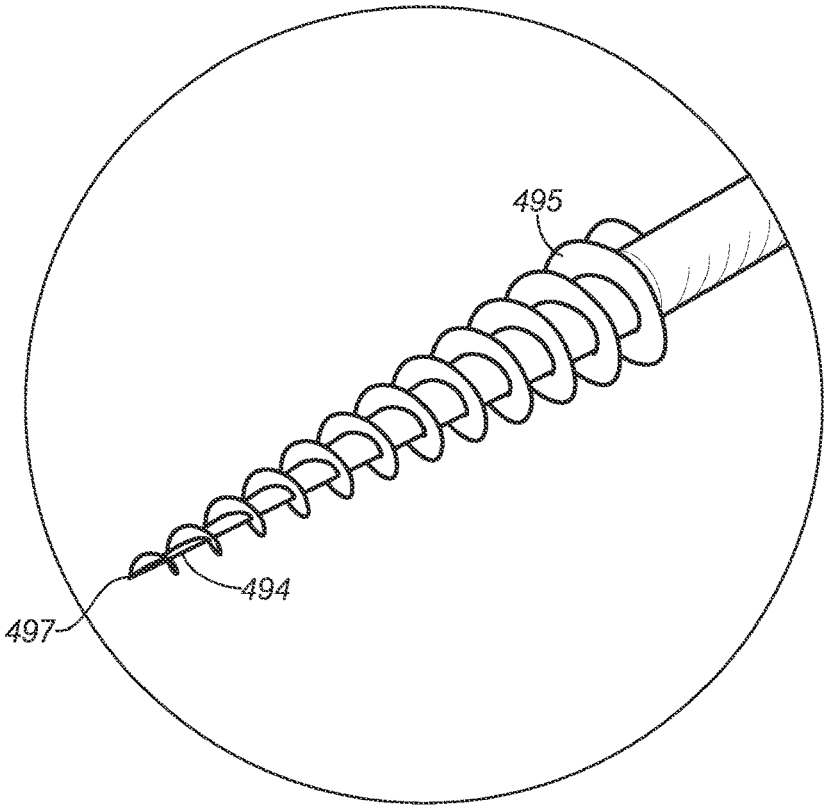
FIG. 39 is a close-up of the tapered tip of the filter tool with a downward incline plane wrapping around the tip.
Figure 40:
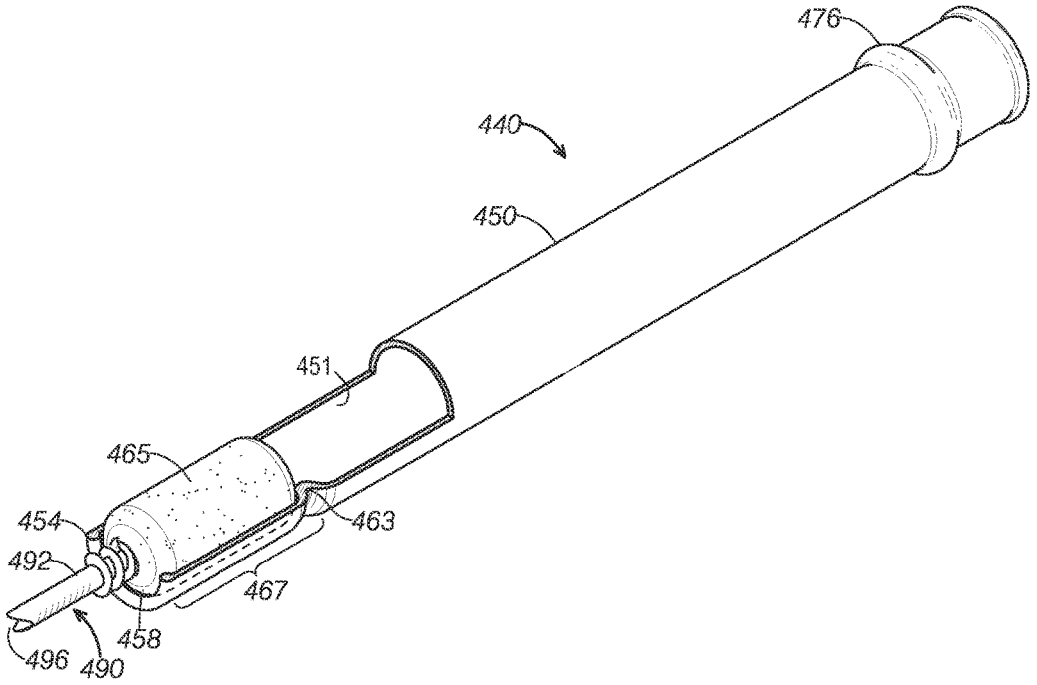
FIG. 40 is a perspective of the filter tool coupled to the filter while the filter is within the smoking apparatus.

Turning to FIGS. 38-40, a filter tool 490 of smoking apparatus 440 will now be described. Fitter tool 490 includes a wand 492 and a tapered tip 497 attached to wand 492. Alternatively, tapered tip 497 may be a contiguous part of filter tool 490.

Filter tool 490 includes a tapered tip 497 configured to couple with filter 465 seated within filter region 462 of filter holder 467. Filter tool 490 thus allows the user to easily extract filter 465 from filter holder 467 of smoking apparatus 440. In some instances, the filter tool is used to remove a flexible screen 442 by pushing flexible screen 442 out of smoking apparatus 440.

As can be seen in FIGS. 38-40, filter tool 490 includes a filter tool first end 494 and a filter tool second end 496. Tapered tip 497 is disposed proximate to filter tool first end 494 and wand 492 is disposed proximate to filter tool second end 496.

The reader can see in FIGS. 38-40 that tapered tip 497 comes to a point at first end 494. Tapered tip 497 includes an inclined plane 495 projecting front the surface of tapered tip 497 and wrapping around tapered tip 497. Tapered tip 497 with its point and inclined plane 495 defines a screw or auger configured to screw into, i.e., penetrate and couple with, compressible filter 465.

When tapered tip 497 of filter tool 490 is in use, the pointed tip and inclined plane projections of tapered tip 497 contact, penetrate, and couple with compressible filter 465. By penetrating and coupling with compressible filter 465, tapered tip 497 and its inclined plane 495 allow the user to pull compressible filter 465 out of filter holder 467 of smoking apparatus 440. In particular, tapered tip 497 enables a user to pull compressible filter 465 out of filter region 462 and past retainer lip 458 when required. It also follows that the overall cross-sectional dimension of the entire tapered tip 497 and inclined plane 495 should be less than the cross-sectional dimension interior opening of retainer lip 458 in order for tapered tip 497 of filter tool 490 to couple with compressible filter 465.

Filter tool 490 can be made of a variety of materials, including but not limited to plastic, metal, wood and so forth. Furthermore, the projections from tapered tip of filter tool first end 494 for coupling with compressible filter 465 can be any form such as hooks, points or any projections that couples to compressible filter 465.

FIGS. 38-40 also show that wand 492 is relatively blunt at filter tool second end 496. By being blunt, a user can conveniently use filter tool second end 496 to push the flexible screen past screen retainer 472 and out of bowl 460 by inserting filter tool second end 496 through second end 454 of smoking apparatus 440 past filter stop 463 and shoulder support 480 to eject flexible screen 442 from lateral boundary region 476 past screen retainer 472 and freeing flexible screen 442 from bowl 460 End from smoking apparatus 440.

Staying with FIGS. 38-40, first end 497 and wand 492 of filter tool 490 has a major cross-sectional dimension, in this case a diameter, which is smaller than the diameters of the opening of retainer lip 458, filter stop 463, and shoulder support 480. In those examples, the relatively small diameter allows wand 492 to easily slide through the entire length of smoking apparatus 440 to eject a flexible screen from lateral boundary region 476 and past screen retainer 472 thereby freeing the flexible screen from bowl 460 and smoking apparatus 440. In other examples, wand 492 of filter tool 490 may have a non-cylindrical cross-section.

In the present example, filter tool 490 has a length that allows user to easily grip filter tool 490 when ejecting flexible screen 442 past screen retainer 472. In other examples, filter tool has a length greater than the length of smoking apparatus 440.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes novel and non-obvious combinations and sub-combinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A smoking apparatus for a smoking product, comprising:

a substantially hollow stem defining a bore having a bore cross-sectional dimension, the hollow stem including a first end and a second end disposed opposite the first end, the second end defining a retainer lip and a retainer lip opening for drawing vapor out of the hollow stem via the second end, and a hollow, empty central region having opposite first and second ends spaced from the first and second end of the stem, respectively;

a bowl proximate the first end of the hollow stem and configured to receive the smoking product;

a filter stop disposed between the second end of the central region of the hollow stem and the second end of the hollow stem and projecting into the bore of the hollow stem, the filter stop defining a filter stop opening providing space for fluid communication through the filter stop opening; and a filter region disposed adjacent the second end of the hollow stem between the filter stop and the second end of the hollow stem, the filter region being configured to receive a removable filter, wherein the substantially hollow stem, the bowl, the filter stop, and the filter region are all integrally coupled;

a compressible filter having a substantially uncompressed state of larger dimensions than the retainer lip opening and a compressed state of smaller dimensions, whereby the filter is configured for reception in the filter region through the retainer lip opening when in the compressed state, wherein the retainer lip and the filter stop cooperate to receive a compressible filter inserted through the retainer lip opening in a compressed state into the filter region and retain the compressible filter in the filter region in a substantially uncompressed state between the retainer lip and the filter stop;

wherein the bore cross-sectional dimension is configured with a cross-sectional dimension of the compressible filter in a substantially uncompressed state to enable the compressible filter to fit closely within the filter region when the compressible filter is in the substantially uncompressed state;

wherein a cross-sectional dimension of the retainer lip opening is complimentarily configured with the cross-sectional dimension of the compressible filter in a compressed state to enable the compressible filter to pass through the retainer lip opening;

a filter tool with a tapered tip having a screw configuration to screw into the filter to remove the filter from the filter region through the retainer lip opening.

2. The smoking apparatus of claim 1, wherein the filter region is configured to receive a removable filter through the retainer lip opening at the second end.

3. The smoking apparatus of claim 1, further including a removable compressible filter disposed in the filter region and contacting the retainer lip at the second end.

4. The smoking apparatus of claim 1, further including a removable compressible filter disposed in the filter region and contacting the filter stop, which is integral with the stem.

5. The smoking apparatus of claim 1, further comprising a filter tool with a tapered tip having a screw configuration to screw into the filter to remove the filter from the filter region through the retainer lip opening.

6. A smoking apparatus for a smoking product, comprising:

a substantially hollow stem defining a bore having a bore cross-sectional dimension, the hollow stem including a first end and a second end disposed opposite the first end, the second end defining a retainer lip and a retainer lip opening for drawing vapor out of the hollow stem via the second end;

a bowl proximate the first end of the hollow stem and configured to receive the smoking product;

a filter stop disposed between the bowl and the second end of the hollow stem and projecting into the bore of the hollow stem, the filter stop defining a filter stop opening providing space for fluid communication through the filter stop opening;

a filter region disposed between the filter stop and the second end of the hollow stem; and a filter tool for removing a filter from the filter region through the retainer lip opening;

wherein the retainer lip and the filter stop cooperate to receive a compressible filter inserted through the retainer lip opening in a compressed state into the filter region and retain the compressible filter in the filter region in a substantially uncompressed state between the retainer lip and the filter stop;

the bore cross-sectional dimension is configured with a cross-sectional dimension of the compressible filter in a substantially uncompressed state to enable the compressible filter to fit closely within the filter region when the compressible filter is in the substantially uncompressed state;

a cross-sectional dimension of the retainer lip opening is complimentarily configured with the cross-sectional dimension of the compressible filter in a compressed state to enable the compressible filter to pass through the retainer lip opening; and the filter tool includes a tapered tip configured to pierce and thereby couple with the compressible filter, the tapered tip including a tip surface and an inclined plane projecting from the tip surface, the inclined plane wrapping around the tapered tip.

7. The smoking apparatus of claim 6, wherein the tapered tip includes a screw configuration to screw into the filter to remove the filter from the filter region through the retainer lip opening.

8. The smoking apparatus of claim 6, wherein the substantially hollow stem, the bowl, the filter stop, and the filter region are all integrally coupled.

9. The smoking apparatus of claim 6, wherein the filter region is configured to receive a removable filter through the retainer lip opening at the second end.

10. The smoking apparatus of claim 6, further including a removable compressible filter disposed in the filter region and contacting the retainer lip at the second end.

11. The smoking apparatus of claim 6, further including a removable compressible filter disposed in the filter region and contacting the filter stop, which is integral with the stem.

12. A smoking apparatus for a smoking product, comprising:

a substantially hollow stem defining a bore having a bore cross-sectional dimension, the hollow stem including a first end and a second end disposed opposite the first end, the second end defining a retainer lip and a retainer lip opening for drawing vapor out of the hollow stem via the second end, and a hollow, empty central region having opposite first and second ends spaced from the first and second end of the stem, respectively;

a bowl proximate the first end of the hollow stem and configured to receive the smoking product;

a filter stop disposed between the second end of the central region of the hollow stem and the second end of the hollow stem and projecting into the bore of the hollow stem, the filter stop defining a filter stop opening providing space for fluid communication through the filter stop opening; and a filter region disposed adjacent the second end of the hollow stem between the filter stop and the second end of the hollow stem, the filter region being configured to receive a removable filter, a removable compressible filter disposed in the filter region and contacting the filter stop, which is integral with the stem, a filter tool with a tapered tip having a screw configuration to screw into the filter to remove the filter from the filter region through the retainer lip opening.

13. The smoking apparatus of claim 12, wherein the filter region is configured to receive the removable filter through the retainer lip opening at the second end.

14. The smoking apparatus of claim 12, wherein the removable compressible filter contacts the retainer lip at the second end.

* * * * *